US010026549B2

(12) United States Patent
Kawachi et al.

(10) Patent No.: US 10,026,549 B2
(45) Date of Patent: Jul. 17, 2018

(54) METHOD OF MANUFACTURING AN ELECTRONIC COMPONENT

(71) Applicant: Murata Manufacturing Co., Ltd., Kyoto (JP)

(72) Inventors: Takao Kawachi, Saitama (JP); Yoshiharu Sato, Saitama (JP); Takahiro Ogawa, Saitama (JP); Isao Ida, Saitama (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 117 days.

(21) Appl. No.: 15/107,728

(22) PCT Filed: Nov. 17, 2014

(86) PCT No.: PCT/JP2014/080398

§ 371 (c)(1),
(2) Date: Jun. 23, 2016

(87) PCT Pub. No.: WO2015/098355

PCT Pub. Date: Jul. 2, 2015

(65) Prior Publication Data

US 2016/0322160 A1 Nov. 3, 2016

(30) Foreign Application Priority Data

Dec. 27, 2013 (JP) ..... 2013-271626

(51) Int. Cl.
*H01F 7/06* (2006.01)
*H01F 41/04* (2006.01)
(Continued)

(52) U.S. Cl.
CPC ..... *H01F 41/04* (2013.01); *H01F 27/2871* (2013.01); *H01F 27/292* (2013.01); *H01F 27/306* (2013.01); *H01F 2017/048* (2013.01)

(58) Field of Classification Search
CPC .. H01F 27/292; H01F 27/2871; H01F 27/306; H01F 38/14; H01F 41/02;
(Continued)

(56) References Cited

U.S. PATENT DOCUMENTS 5,633,069 A * 5/1997 Shimizu ..... H05K 3/0014 428/192
6,759,935 B2 * 7/2004 Moro ..... B22F 7/08 29/602.1
(Continued)

FOREIGN PATENT DOCUMENTS

JP 2009-170488 A 7/2009
JP 2011-3761 A 1/2011
(Continued)

OTHER PUBLICATIONS

International Search Report issued in Application No. PCT/JP2014/080398, dated Feb. 17, 2015 and English translation thereof (3 pages).
(Continued)

*Primary Examiner* — Paul D Kim
(74) *Attorney, Agent, or Firm* — Nakanishi IP Associates, LLC

(57) ABSTRACT

A method of manufacturing an electronic component includes: a coil forming step of forming a winding coil by a wire-shaped conductor; a press fitting step of embedding the winding coil into a plate-shaped composite magnetic material in a state in which the plate-shaped composite magnetic material is softened, the plate-shaped composite magnetic material being a composite magnetic material that is formed in a plate shape and in which magnetic particles and a resin are mixed; a covering step of covering a part of the winding coil with another plate-shaped composite magnetic material that is softened, the part of the coil being a part remaining uncovered in the press fitting step; a pressurizing step of
(Continued)

pressurizing and molding an entirety; and, a hardening step of hardening the composite magnetic material.

3 Claims, 13 Drawing Sheets

(51) Int. Cl.
*H01F 27/28* (2006.01)
*H01F 27/29* (2006.01)
*H01F 27/30* (2006.01)
*H01F 17/04* (2006.01)

(58) Field of Classification Search
CPC .. H01F 41/041; H05K 1/0233; H05K 1/0298; H05K 1/115; H05K 1/165; H05K 1/181; H05K 9/0075
See application file for complete search history.

(56) References Cited

U.S. PATENT DOCUMENTS 7,199,693 B2 * 4/2007 Matsutani ..... H01F 21/12 336/192
8,695,209 B2 * 4/2014 Saito ..... H01F 27/292 29/602.1
9,165,710 B2 * 10/2015 Saito ..... H01F 27/292
9,589,716 B2 * 3/2017 Doljack ..... H01F 17/04
9,761,373 B2 * 9/2017 Stark ..... H01F 41/04
2005/0030143 A9 * 2/2005 Satoh ..... A61B 8/08 336/200
2006/0001517 A1 * 1/2006 Cheng ..... H01F 27/292 336/83

FOREIGN PATENT DOCUMENTS

JP 4705191 B1 6/2011
JP 4714779 B2 6/2011
JP 2012-526384 A 10/2012
WO 2010/129230 A1 11/2010

OTHER PUBLICATIONS

Written Opinion of the International Searching Authority issued in International Application No. PCT/JP2014/080398, dated Feb. 17, 2015 (3 pages).
Office Action dated Jun. 26, 2017, in Korean Patent Application No. 10-2016-7007116, with English Translation (10 pages).
Written Opinion of International Searching Authority issued in International Application No. PCT/JP2014/080398, dated Feb. 17, 2015, with English translation (6 pages).

* cited by examiner

METHOD OF MANUFACTURING AN ELECTRONIC COMPONENT

TECHNICAL FIELD

The present invention relates to a method of manufacturing an electronic component used as a power inductor or the like of a power supply circuit, and such an electronic component.

BACKGROUND ART

A power inductor used for a power supply circuit is required to be small, low-loss, and capable of responding to high current. In order to respond to these demands, there have been developed inductors employing, as a magnetic material of such inductors, a composite magnetic material such as metal magnetic powder having high saturation magnetic flux density (e.g., Japanese Patent No. 4714779). One advantage of the inductors employing a composite magnetic material is high direct-current superimposed allowable current. However, in order to reduce a size of the component while maintaining self-inductance L, it is necessary that a part made of the composite magnetic material to be thin. In this case, a power inductor having a structure in which a coil is embedded in a composite magnetic material is manufactured one by one, and accordingly poses a problem that separation of the composite magnetic material easily occurs at a portion where the composite magnetic material is thin, especially on a side of the component, resulting in a poor yield ratio and difficulty in size reduction.

There is another conventional approach of molding a core using granulated powder, placing a coil in the core, and performing compression molding one by one. However, with this conventional approach, inductors cannot be manufactured unless a core is molded using granulated powder. In particular, as a side wall is required to be made thin to reduce a size, it is not possible to manufacture a molding mold for molding a core, and thus there is a problem that size reduction is difficult.

SUMMARY OF INVENTION

An object of one or more embodiments according to the present invention is to provide a method of manufacturing an electronic component with high self-inductance L, high allowable current, and that can be easily made small at an excellent yield ratio, as well as to provide such an electronic component.

The present invention addresses the above problems based on the following solutions, which are described with references made to numbers of embodiments according to the present invention in order to facilitate understanding. However, the solutions are not limited to these embodiments.

Embodiment 1

One or more embodiments according to the present invention provides a method of manufacturing an electronic component, the method including: a coil forming step of forming a coil by a wire-shaped conductor; a press fitting step of embedding the coil into a plate-shaped composite magnetic material in a state in which the plate-shaped composite magnetic material is softened, the plate-shaped composite magnetic material being a composite magnetic material that is formed in a plate shape and in which magnetic particles and a resin are mixed; a covering step of covering a part of the coil with another plate-shaped composite magnetic material that is softened, the part of the coil being apart remaining uncovered in the press fitting step; a pressurizing step of pressurizing and molding an entirety; and a hardening step of hardening the composite magnetic material.

Embodiment 2

One or more embodiments according to the present invention provides the method of manufacturing an electronic component according to Embodiment 1, wherein at least the press fitting step and the steps following the press fitting step are performed to more than one at the same time coil using the plate-shaped composite magnetic material having a size on which a plurality of coils are placeable.

Embodiment 3

One or more embodiments according to the present invention provides the method of manufacturing an electronic component according to Embodiment 1, wherein the pressurizing step and the hardening step are performed at the same time.

Embodiment 4

One or more embodiments according to the present invention provides an electronic component including: a coil formed by a wire-shaped conductor; and a magnetic body formed of a composite magnetic material so as to cover the coil excluding a terminal, the composite magnetic material being a material that is hardened and in which magnetic particles and a resin are mixed, wherein the magnetic body is formed by embedding the coil into a plate-shaped composite magnetic material in a state in which the plate-shaped composite magnetic material is softened, and then hardening the plate-shaped composite magnetic material, the plate-shaped composite magnetic material being a composite magnetic material that is formed in a plate shape.

Embodiment 5

One or more embodiments according to the present invention provides the electronic component according to Embodiment 4 manufactured based on the method of manufacturing an electronic component defined in one of Embodiments 1 to 3.

(1) In one or more embodiments according to the present invention, a method of manufacturing an electronic component includes: a coil forming step of forming a coil by a wire-shaped conductor; a press fitting step of embedding the coil into a plate-shaped composite magnetic material in a state in which the plate-shaped composite magnetic material is softened, the plate-shaped composite magnetic material being a composite magnetic material that is formed in a plate shape and in which magnetic particles and a resin are mixed; a covering step of covering a part of the coil with another plate-shaped composite magnetic material that is softened, the part of the coil being a part remaining uncovered in the press fitting step; a pressurizing step of pressurizing and molding an entirety; and a hardening step of hardening the composite magnetic material. Therefore, according to one or more embodiments of the present invention, it is possible to manufacture an electronic component at an excellent yield ratio even if the magnetic body is made thin. Specifically, the electronic component as a whole may be made small in size by making the magnetic body thin without downsizing the coil itself. Thus, according to one or more embodiments of the present invention, it is possible to manufacture an electronic component at an excellent yield ratio and to facilitate downsizing of the electronic component, even when self-inductance L and allowable current of the electronic component are maintained to be high.

(2) in one or more embodiments according to the present invention, at least the press fitting step and the steps following the press fitting step are performed to more than one coil at the same time using the plate-shaped composite magnetic material having a size on which a plurality of coils are placeable. Thus, according to one or more embodiments of the present invention, it is possible to manufacture an electronic component efficiently.

(3) In one or more embodiments according to the present invention, the pressurizing step and the hardening step are performed at the same time. Thus, according to one or more embodiments of the present invention, it is possible to manufacture an electronic component efficiently, and to make a magnetic body more rigid.

(4) in one or more embodiments according to the present invention, an electronic component includes: a coil formed by a wire-shaped conductor; and a magnetic body formed of a composite magnetic material so as to cover the coil excluding a terminal, the composite magnetic material being a material that is hardened and in which magnetic particles and a resin are mixed. The magnetic body is formed by embedding the coil into a plate-shaped composite magnetic material in a state in which the plate-shaped composite magnetic material is softened, and then hardening the plate-shaped composite magnetic material, the plate-shaped composite magnetic material being a composite magnetic material that is formed in a plate shape. Thus, according to one or more embodiments of the present invention, it is possible to manufacture an electronic component with high self-inductance L, high allowable current, and that can be easily made small at an excellent yield ratio.

DESCRIPTION OF EMBODIMENTS

Hereinafter, best modes for carrying out the present invention will be described with reference to the drawings.

First Embodiment

Figure 1:
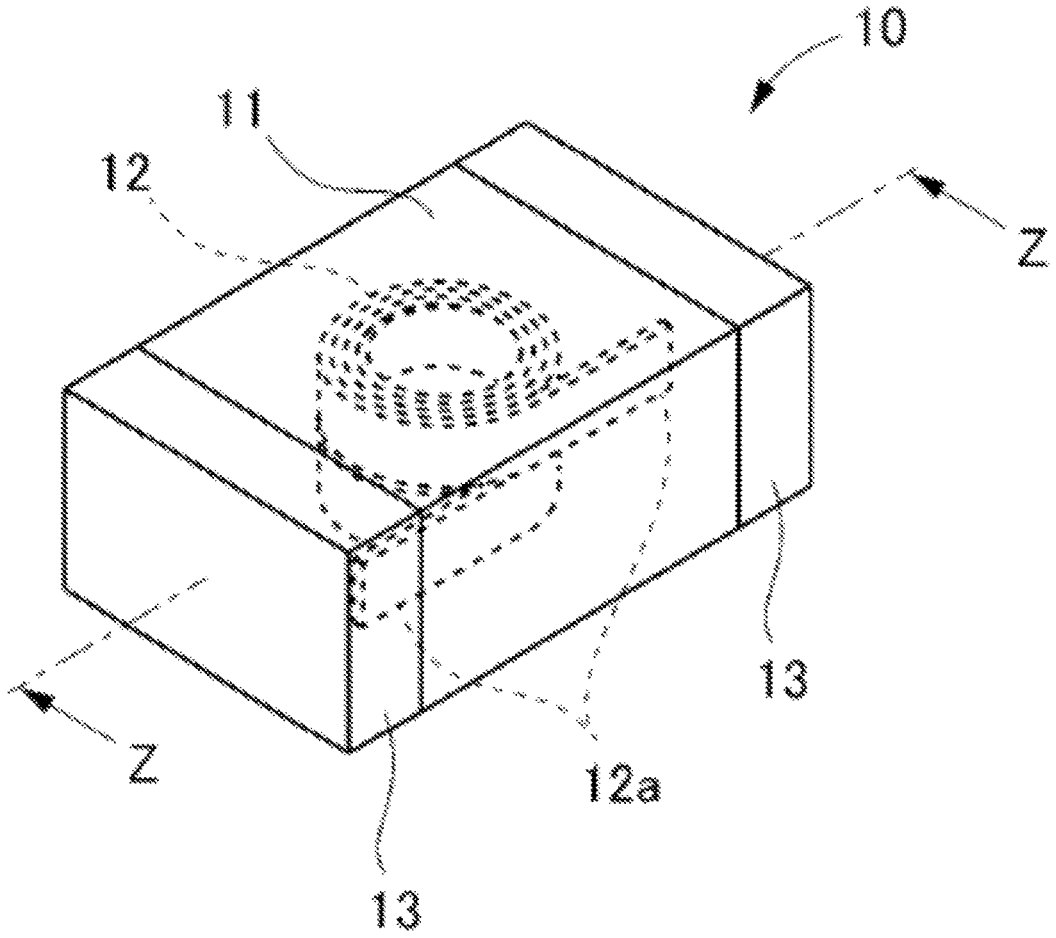
FIG. 1 is a perspective view illustrating a first embodiment of an electronic component 10 according to the present invention.

FIG. 1 is a perspective view illustrating a first embodiment of an electronic component 10 according to the present invention.

Figure 2:
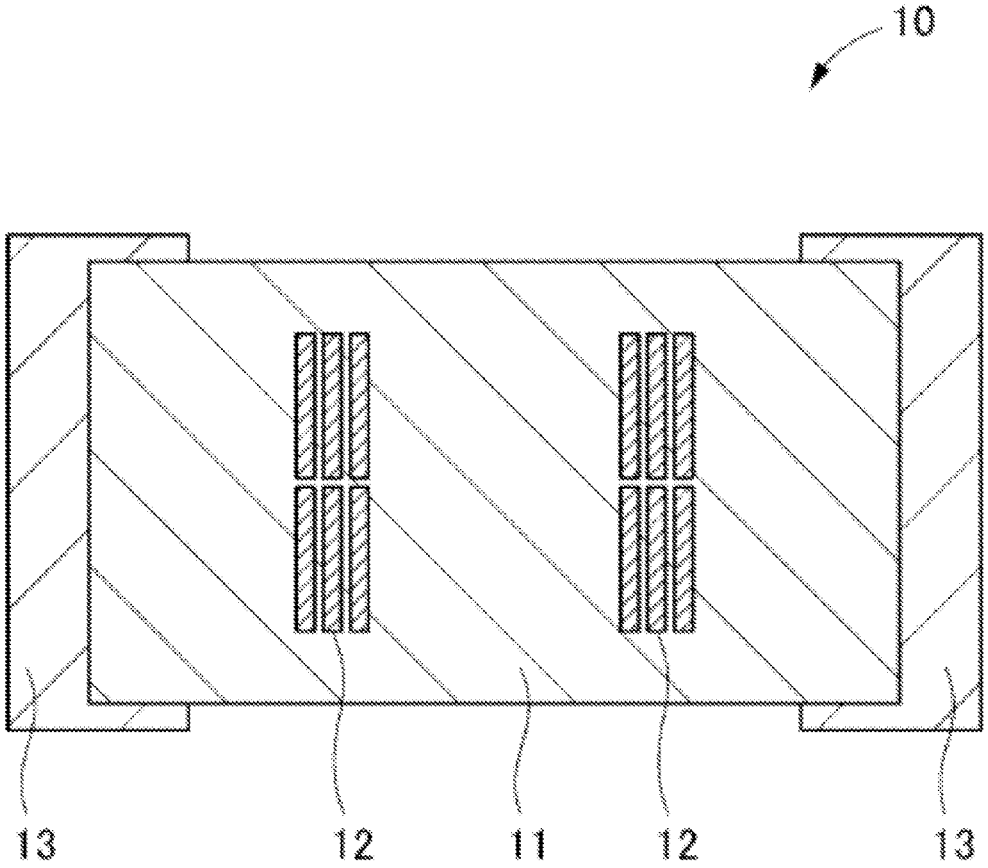
FIG. 2 is a longitudinal sectional view of the electronic component 10 taken along line Z-Z in FIG. 1.

FIG. 2 is a longitudinal sectional view of the electronic component 10 taken along line Z-Z in FIG. 1.

In order to facilitate understanding, terms such as top and bottom are used in the following description. However, these terms only refer to directions in the drawings, and shall not limit a configuration of the present invention.

It should be noted that the drawings including FIG. 1 are schematic views, and sizes and shapes of components are shown exaggeratingly as needed, in order to facilitate understanding.

Further, while references are made to specific values, shapes, materials, and the like in the following description, these specifics may be altered as needed.

The electronic component 10 is an inductor including a magnetic body 11, a winding coil 12, and external terminals 13.

The magnetic body 11 is formed by hardening a composite magnetic material in which magnetic particles and a resin are mixed. As an example of the composite magnetic material, a material in which ferrous metal magnetic powder and an epoxy resin are mixed may be used. The magnetic body 11 is provided so as to fill a space where the winding coil 12 is not present without any gap.

The winding coil 12 is formed by winding a rectangular wire into a two-tiered coil in an α-wound manner (outside-to-outside manner). Further, both ends 12*a* of the winding coil 12 extend respectively to both ends of the electronic component 10 from the same side of the winding coil 12.

Each of the external terminals 13 is a terminal made of a conductive material such as silver or copper, so as to be conducted to either of the both ends 12*a* of the winding coil 12 on both ends of the electronic component 10.

Next, a method of manufacturing the electronic component 10 according to this embodiment will be described.

FIGS. 3A, 3B, 4C, 4D, and 4E show views illustrating a manufacturing process of the electronic component 10 according to the first embodiment.

(First Step: Coil Forming Step)

Figure 3A:
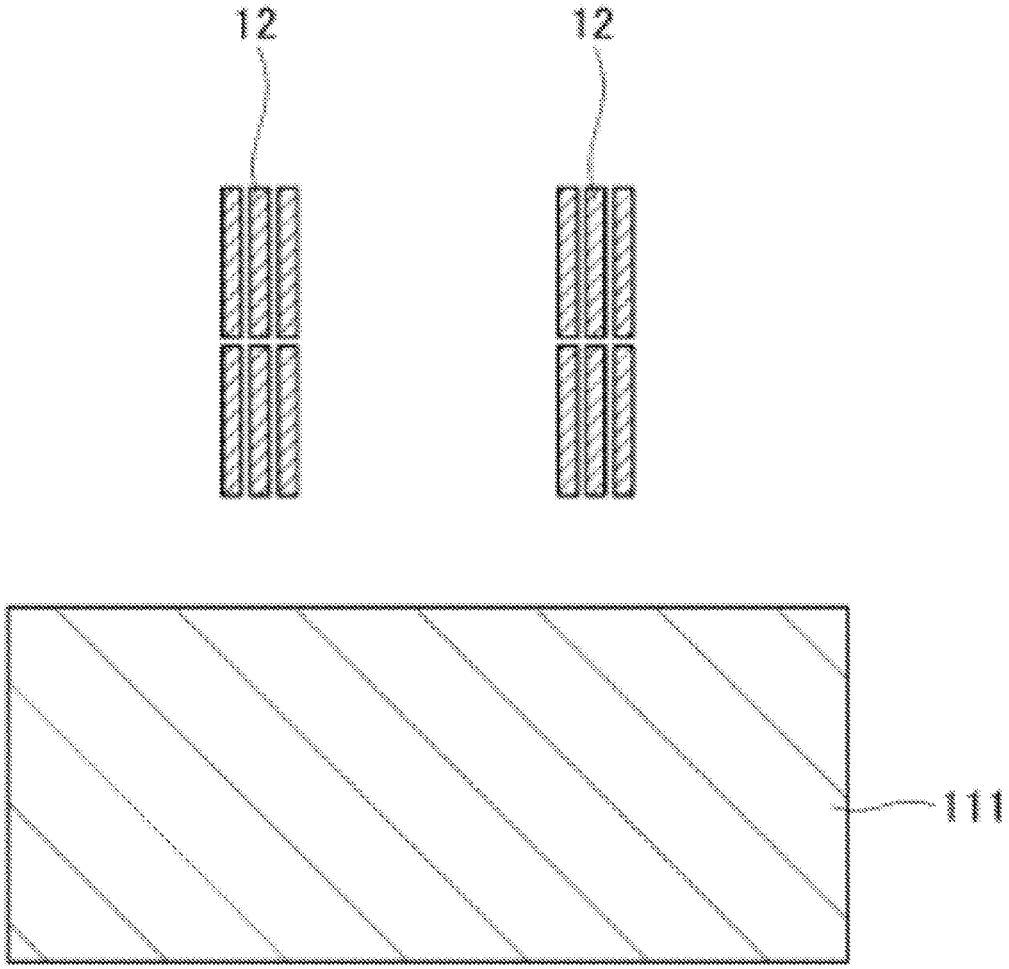
FIGS. 3A and 3B show views illustrating a manufacturing process of the electronic component 10 according to the first embodiment.

First, as illustrated in FIG. 3A, the winding coil 12 is formed by a rectangular wire (coil forming step), and a plate-shaped composite magnetic material 111 which is a material for the magnetic body 11 is prepared.

(Second Step: Press Fitting Step)

Figure 3B:
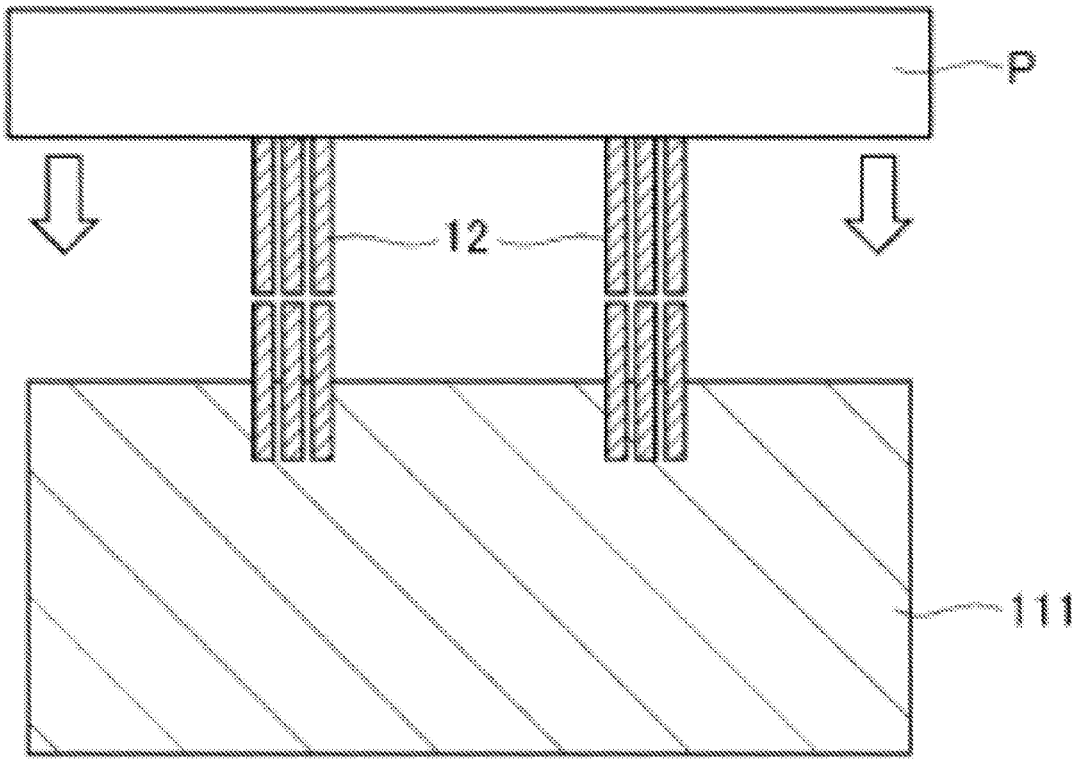

Next, the plate-shaped composite magnetic material 111 is heated up to a temperature from 70 degrees C. to 120 degrees C. Then, as illustrated in FIG. 3B, in a state in which the plate-shaped composite magnetic material 111 is softened, the winding coil 12 is pressed against the plate-shaped composite magnetic material 111 using a press mold P, and the winding coil 12 is embedded into the plate-shaped composite magnetic material 111.

(Third Step: Covering Step)

Figure 4C:
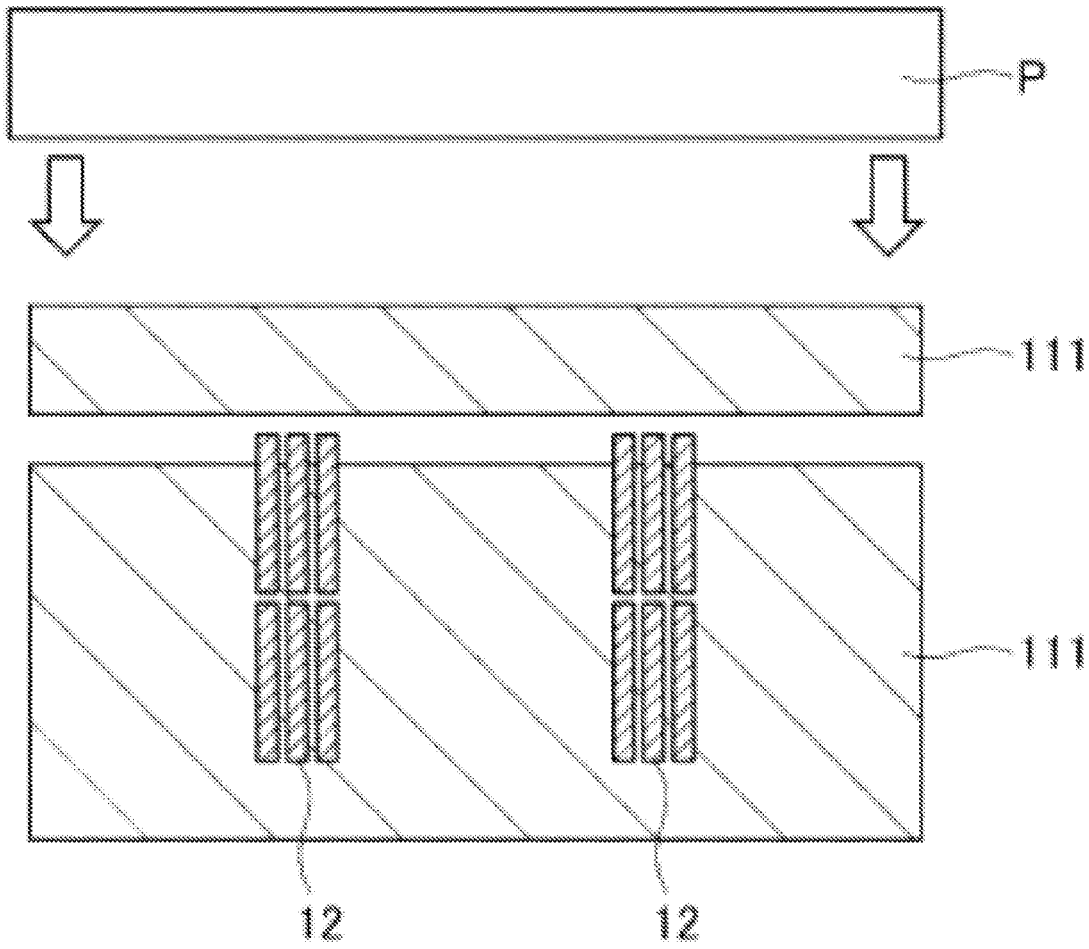
FIGS. 4C, 4D, and 4E show views illustrating the manufacturing process of the electronic component 10 according to the first embodiment.

Next, as illustrated in FIG. 4C, another plate-shaped composite magnetic material 111 that is softened is further placed so as to cover the winding coil 12 that remains uncovered in the second step. Then, the material is pressed using the press mold P. With this, an upper surface of the winding coil 12 is also covered by the plate-shaped composite magnetic materials 111, and a state shown in FIG. 4D is realized.

(Fourth Step: Pressurizing Step and Hardening Step)

Figure 4D:
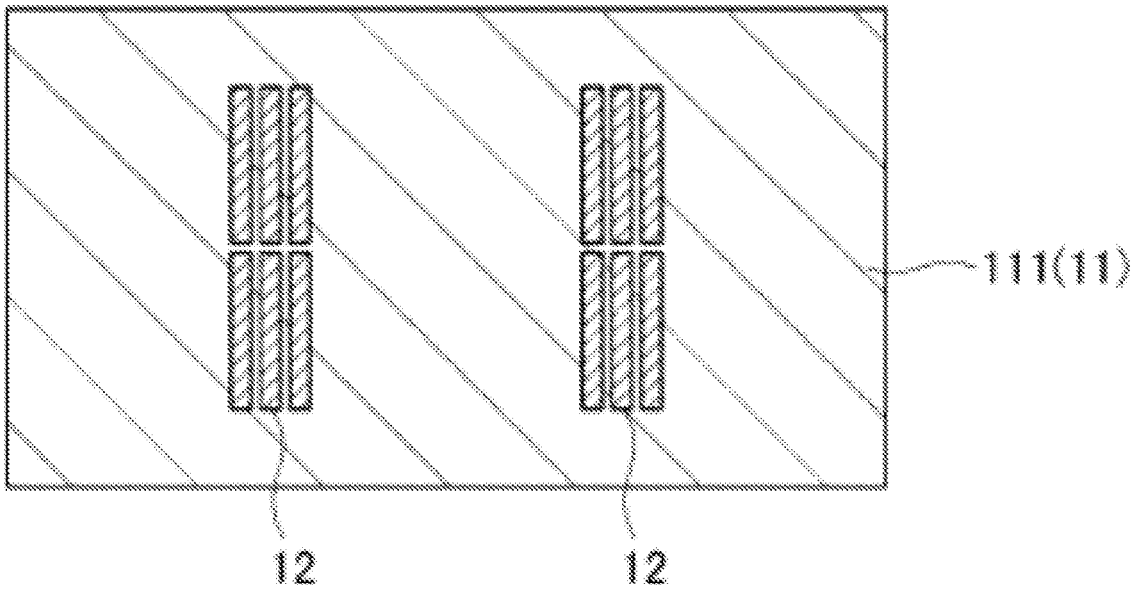

Next, while maintaining a temperature from 150 degrees C. to 200 degrees C., the plate-shaped composite magnetic materials 111 as a whole in the state shown in FIG. 4D are pressurized (pressed) and molded (pressurizing step), and the magnetic body 11 (composite magnetic material) is hardened (hardening step). As the magnetic body 11 is made rigid through the pressurizing step and the hardening step, it is possible to manufacture the electronic component 10 without causing separation and at an excellent yield ratio even if the magnetic body 11 is made thin to have a distance from the winding coil 12 to an outer circumference is from 100 μm to 200 μm, for example. Thus, according to the manufacturing method of this embodiment, the electronic component 10 may be made small in size.

Here, pressurization and hardening may be performed separately, or the magnetic body 11 may be hardened at the same time when the plate-shaped composite magnetic materials 111 as a whole are pressurized and molded while maintaining temperature from 150 degrees C. to 200 degrees C.

(Fifth Step: External Electrode Forming Step)

Figure 4E:
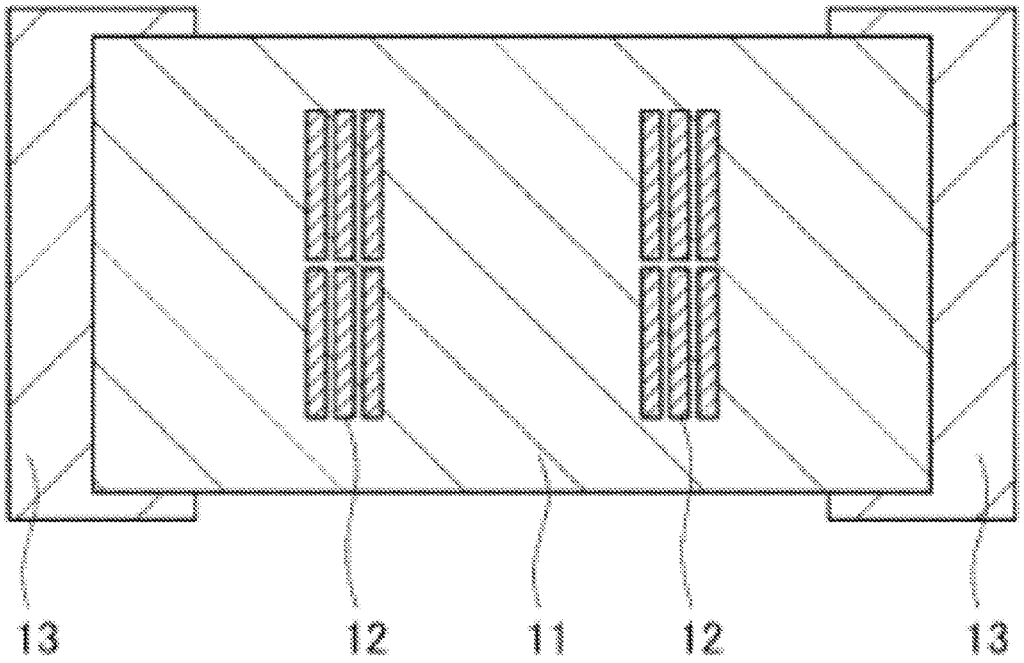

Finally, as illustrated in FIG. 4E, the external terminals 13 are formed on the both ends to complete the electronic component 10 by dipping the component in a conductive paste such as silver or copper, or by sputtering or plating a conductive material such as silver or copper. Here, a cutting step for cutting the magnetic body 11 into a predetermined outer shape may be provided as needed between the fourth step and the fifth step. The external terminals 13 may be formed into a variety of shapes. For example, the external terminals 13 may be formed in an L shape across a bottom surface and an end surface of the magnetic body 11, or may be formed only on the bottom surface of the magnetic body 11.

It should be noted that at least the press fitting step and the steps following the press fitting step among the above steps are performed to more than one winding coil 12 at the same time using the plate-shaped composite magnetic material 111 of a size on which a plurality of winding coils 12 may be placed. With this, it is possible to manufacture the electronic component 10 efficiently.

As described above, according to the first embodiment, the electronic component 10 is manufactured by first forming the winding coil 12, and then press fitting the winding coil 12 into the plate-shaped composite magnetic material 111 to pressurize and harden the composite magnetic material. Therefore, it is possible to manufacture the electronic component 10 at an excellent yield ratio even if the magnetic body 11 is made thin. Specifically, according to the first embodiment, the electronic component 10 as a whole may be made small in size by making the magnetic body 11 thin without downsizing the coil itself.

Thus, according to the first embodiment, it is possible to manufacture the electronic component 10 at an excellent yield ratio and to facilitate downsizing of the electronic component 10, even when self-inductance L and allowable current of the electronic component 10 are maintained to be high.

Further, according to the first embodiment, by placing the plurality of winding coils 12 on the plate-shaped composite magnetic material 111, it is possible to manufacture a plurality of electronic components 10 at the same time, and thus to manufacture the electronic component 10 efficiently.

Second Embodiment

The electronic component 10 according to a second embodiment has a configuration similar to that of the electronic component 10 of the first embodiment other than that its manufacturing method is partially different. Therefore, components having the same functions as those in the first embodiment described above are denoted by the same reference numerals, and repetitive descriptions shall be omitted if not necessary.

In the following, a method of manufacturing the electronic component 10 according to the second embodiment will be described.

FIGS. 5A, 5B, 5C, 6D, 6E, and 6F show views illustrating a manufacturing process of the electronic component 10 according to the second embodiment.

(First Step: Coil Forming Step)

Figure 5A:
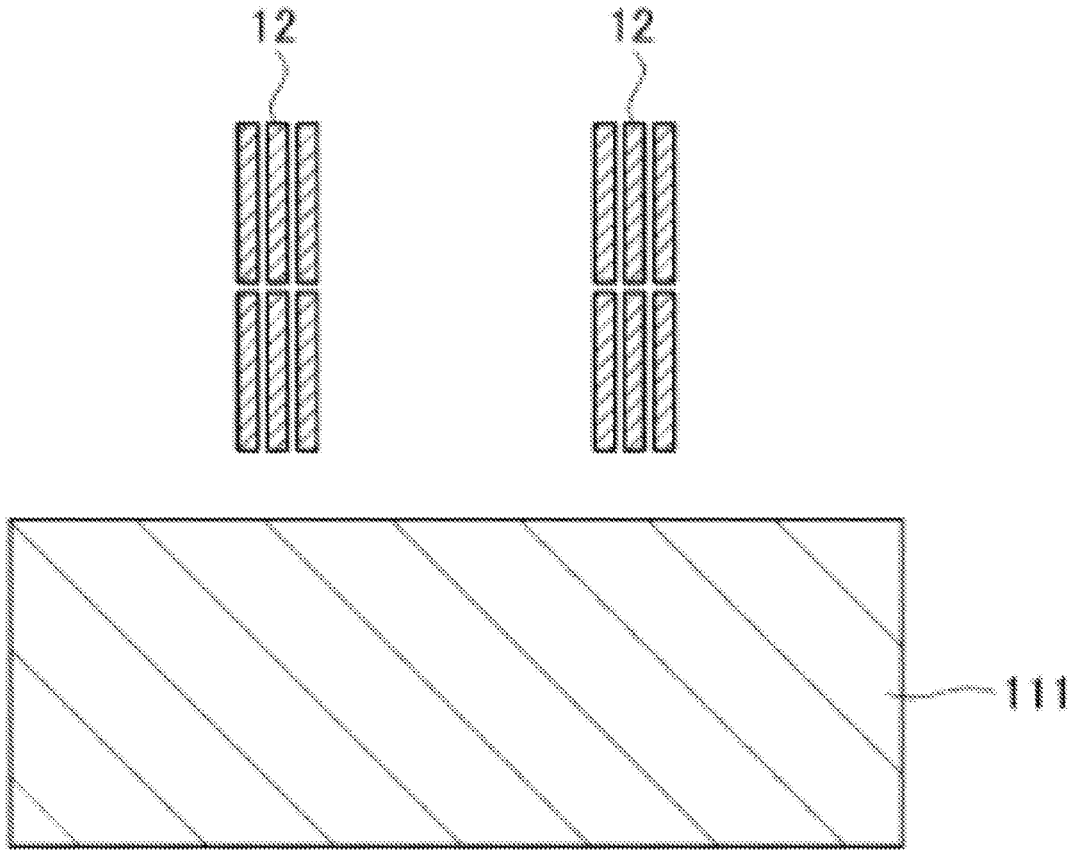
FIGS. 5A, 5B, and 5C show views illustrating a manufacturing process of the electronic component 10 according to a second embodiment.

First, as illustrated in FIG. 5A, the winding coil 12 is formed by a rectangular wire (coil forming step), and a plate-shaped composite magnetic material 111 which is a material for the magnetic body 11 is prepared. A thickness of the plate-shaped composite magnetic material 111 prepared here is substantially the same as a height of the winding coil 12.

(Second Step: Press Fitting Step)

Figure 5B:
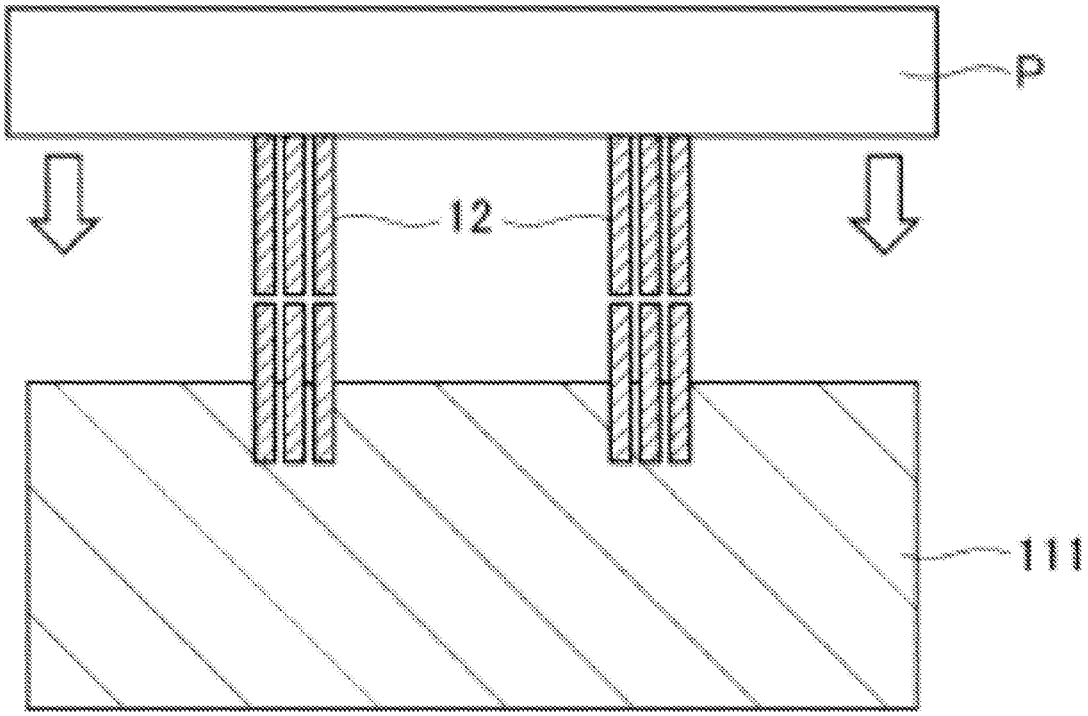

Next, the plate-shaped composite magnetic material 111 is heated up to a temperature from 70 degrees C. to 120 degrees C. Then, as illustrated in FIG. 5B, in a state in which the plate-shaped composite magnetic material 111 is softened, the winding coil 12 is pressed against the plate-shaped composite magnetic material 111 using a press mold P, and the winding coil 12 is embedded into the plate-shaped composite magnetic material 111.

Figure 5C:
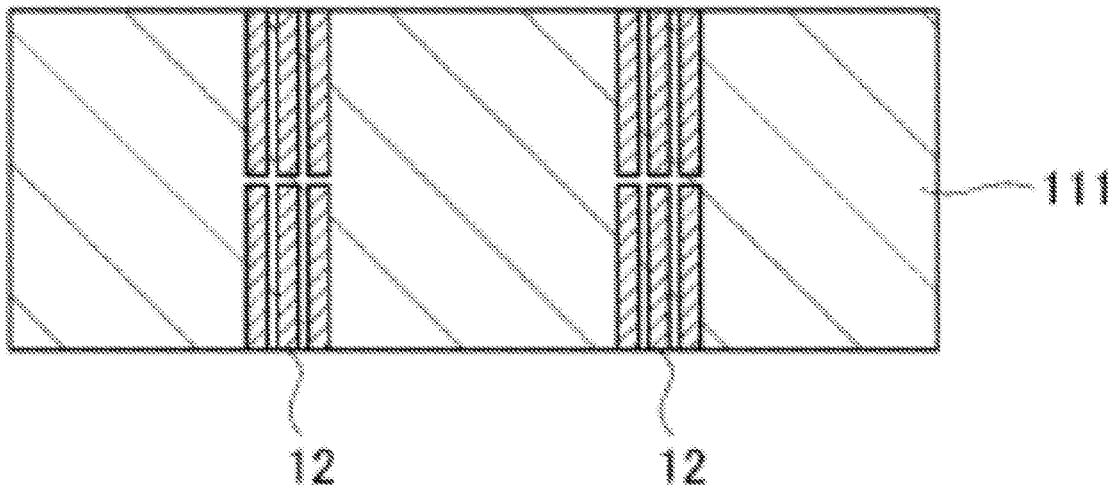

When embedding of the coil is completed, as illustrated in FIG. 5C, only an amount of the composite magnetic material is attached to upper and bottom ends of the winding coil 12, or the upper end and the bottom end of the winding coil 12 are partially exposed.

(Third Step: Covering Step)

Figure 6D:
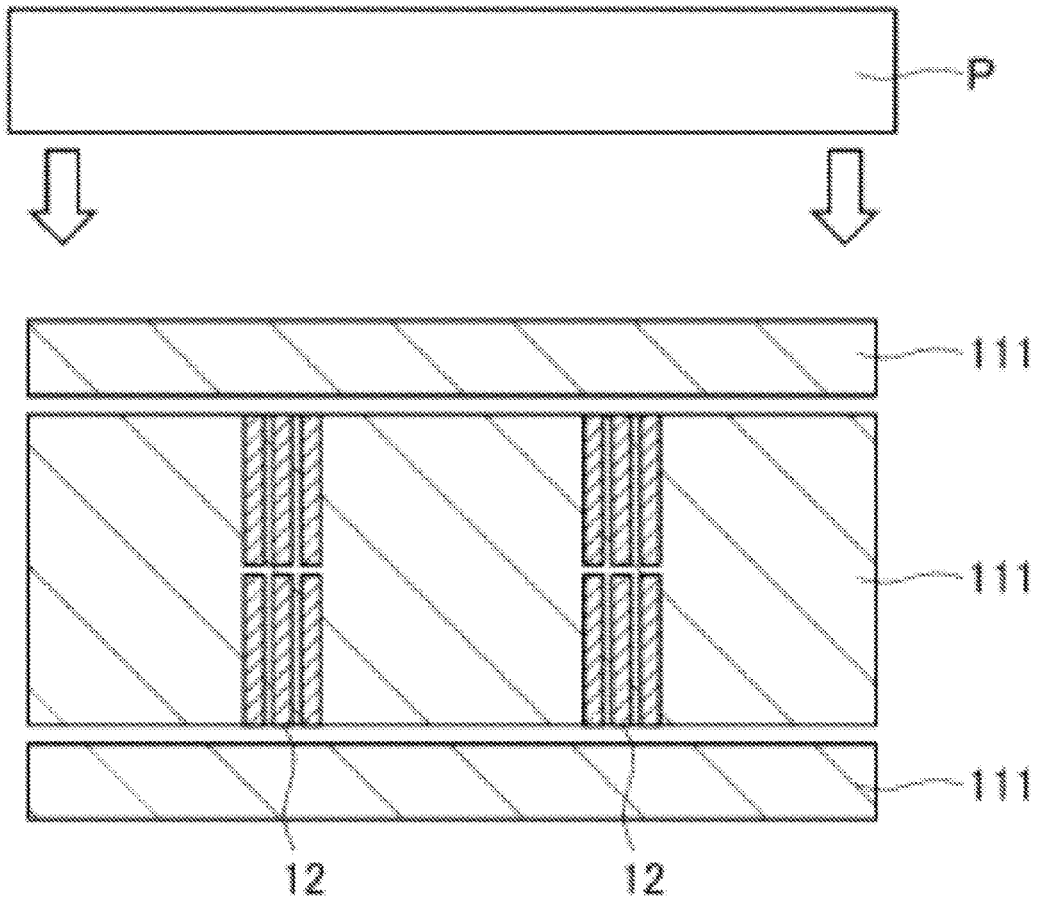
FIGS. 6D, 6E, and 6F show views illustrating the manufacturing process of the electronic component 10 according to the second embodiment.
Figure 6E:
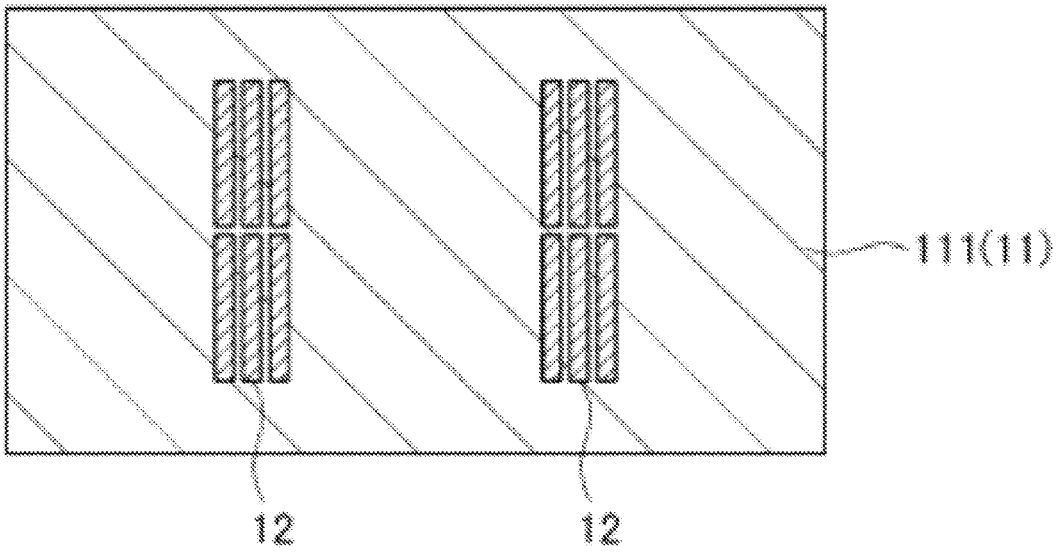

Next, as illustrated in FIG. 6D, two plate-shaped composite magnetic materials 111 that are softened are placed respectively over the top and the bottom of the winding coil 12 that remain uncovered in the second step. Then, the two plate-shaped composite magnetic materials 111 are pressed using the press mold P so as to cover the top and the bottom of the winding coil 12. With this, both an upper surface and a bottom surface of the winding coil 12 are also covered by the plate-shaped composite magnetic materials 111, and a state shown in FIG. 6E is realized. According to the second embodiment, by placing the plate-shaped composite magnetic materials 111 both on the top side and the bottom side, it is possible to more accurately control the thickness of the magnetic body 11 (composite magnetic material) above and below the winding coil 12.

(Fourth Step: Pressurizing Step and Hardening Step)

Next, while maintaining a temperature from 150 degrees C. to 200 degrees C., the plate-shaped composite magnetic materials 111 as a whole in the state shown in FIG. 6E are pressurized (pressed) and molded (pressurizing step), and the magnetic body 11 (composite magnetic material) is hardened (hardening step). As the magnetic body 11 is made rigid through the pressurizing step and the hardening step, it is possible to manufacture the electronic component 10 without causing separation and at an excellent yield ratio even if the magnetic body 11 is made thin to have a distance from the winding coil 12 to an outer circumference is from 100 μm to 200 μm, for example. Further, according to the second embodiment, as the thickness of the magnetic body 11 on the top and the bottom may be accurately controlled, it is possible to reduce production tolerances, and thus to form the magnetic body 11 to be as thin as possible. Thus, according to the manufacturing method of this embodiment, the electronic component 10 may be made small in size. Here, pressurization and hardening may be performed separately, or at the same time.

(Fifth Step: External Electrode Forming Step)

Figure 6F:
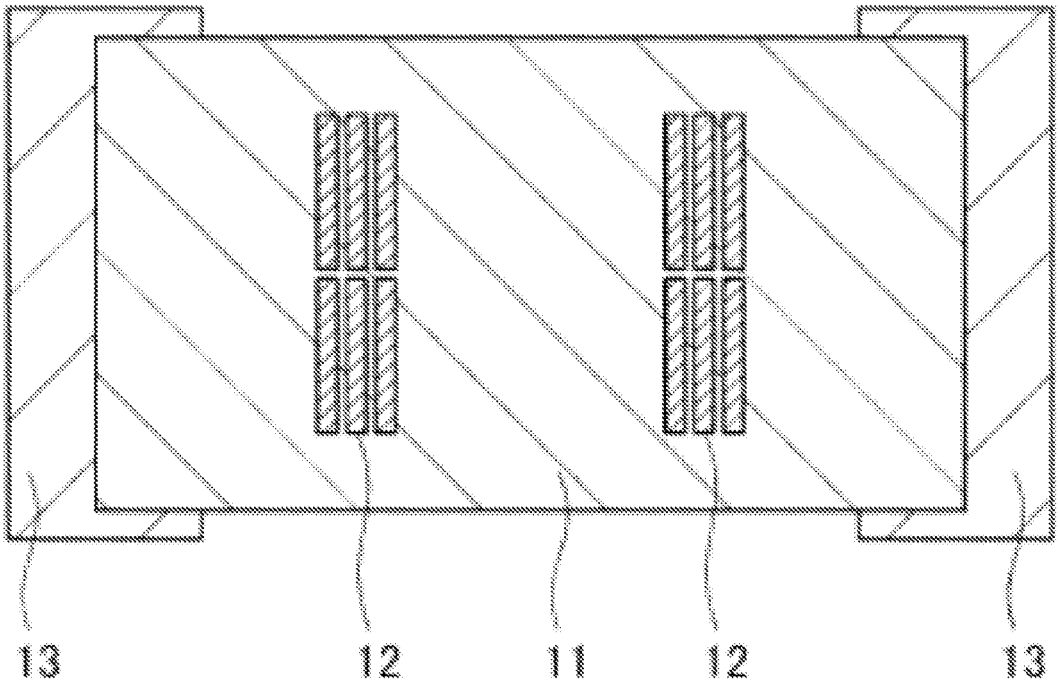

Finally, as illustrated in FIG. 6F, the external terminals 13 are formed on the both ends to complete the electronic component 10 by dipping the component in a conductive paste such as silver or copper, or by sputtering or plating a conductive material such as silver or copper. Here, a cutting step for cutting the magnetic body 11 into a predetermined outer shape may be provided as needed between the fourth step and the fifth step. The external terminals 13 may be formed into a variety of shapes. For example, the external terminals 13 may be formed in an L shape across a bottom surface and an end surface of the magnetic body 11, or may be formed only on the bottom surface of the magnetic body 11.

Similarly to the first embodiment, at least the press fitting step and the steps following the press fitting step among the above steps are performed to more than one winding coil 12 at the same time using the plate-shaped composite magnetic material 111 of a size on which a plurality of winding coils 12 may be placed. With this, it is possible to manufacture the electronic component 10 efficiently.

As described above, according to the second embodiment, the winding coil 12 is covered by the two plate-shaped composite magnetic materials 111 so as to be sandwiched from both sides in the covering step. Therefore, it is possible to more accurately control vertical dimensions, and to manufacture the electronic component 10 at an excellent yield ratio and to be small in size.

Variations

The present invention may not be limited to the embodiments described above, and may be modified and altered in various ways, which are also included within the scope of the present invention.

(1) In the above embodiments, the winding coil 12 is described to be in the α-wound manner as one example. However, the present invention is not limited to such an example, and the winding coil may be wound in an ordinary manner in which both ends are respectively pulled outside and inside.

(2) In the above embodiments, the winding coil 12 is described to have a two-tiered structure as one example. However, the present invention is not limited to such an example, and the winding coil may have a four-stage structure, or may be in any configuration.

It should be noted that the embodiments and the variations described above may be applied in combination as appropriate, but detailed descriptions shall be omitted. Finally, the present invention may not be limited to the embodiments described above.

REFERENCE SIGNS LIST

10: electronic component
11: magnetic body
12: winding coil
12*a*: both ends
13: external terminal
111: plate-shaped composite magnetic material
P: press mold

The invention claimed is:

1. A method of manufacturing an electronic component, the method comprising:

a coil forming step of forming a coil by a wire-shaped conductor;

a press fitting step of embedding the coil into a plate-shaped composite magnetic material in a state in which the plate-shaped composite magnetic material is softened, the plate-shaped composite magnetic material being a first composite magnetic material that is formed in a plate shape and in which magnetic particles and a resin are mixed, each of upper and bottom ends of the coil being partially exposed;

a covering step of disposing second and third plate-shaped composite magnetic materials which are soften on top and bottom of the soften first composite magnetic material, respectively, so as to cover a part of the coil with the second and third plate-shaped composite magnetic materials, the part of the coil being a part remaining uncovered on each of the upper and bottom ends of the coil in the press fitting step;

a pressurizing step of pressurizing and molding an entirety; and a hardening step of hardening the composite magnetic material.

2. The method of manufacturing an electronic component according to claim 1, wherein at least the press fitting step and the steps following the press fitting step are performed to more than one coil at the same time using the plate-shaped composite magnetic material having a size on which a plurality of coils are placeable.

3. The method of manufacturing an electronic component according to claim 1, wherein the pressurizing step and the hardening step are performed at the same time.

* * * * *